United States Patent [19]

Raasch

[11] Patent Number: 4,763,465

[45] Date of Patent: Aug. 16, 1988

[54] BRAKING DEVICE FOR A ROTOR SHAFT OF A ROTOR SPINNING MACHINE

[75] Inventor: Hans Raasch, Monchen-Gladbach, Fed. Rep. of Germany

[73] Assignee: W. Schlafhorst & Co., Fed. Rep. of Germany

[21] Appl. No.: 93,571

[22] Filed: Sep. 4, 1987

[30] Foreign Application Priority Data

Sep. 5, 1986 [DE] Fed. Rep. of Germany ..... 3630256

[51] Int. Cl.[4] ..... D01H 1/243

[52] U.S. Cl. ..... 57/88; 57/406

[58] Field of Search ..... 57/78, 88, 89, 400, 57/406

[56] References Cited

U.S. PATENT DOCUMENTS

| | | | |
|---|---|---|---|
| 3,868,815 | 3/1975 | Stahlecker | 57/88 |
| 4,402,177 | 9/1983 | Grimm et al. | 57/88 |
| 4,574,577 | 3/1986 | Derichs et al. | 57/88 X |

FOREIGN PATENT DOCUMENTS 3343483 6/1985 Fed. Rep. of Germany .

*Primary Examiner*—Donald Watkins

*Attorney, Agent, or Firm*—Shefte, Pinckney & Sawyer

[57] ABSTRACT

A braking device for a rotor shaft of a rotor spinning machine of the type having spaced pairs of rotating bearing support discs. A brake shoe is pivoted for movement upwardly between the bearing support discs and a pair of holddown elements are pivoted for movement downwardly from above the bearing support discs against the rotor shaft to hold the rotor shaft in the nip of the bearing support discs while the brake shoe is acting to brake the rotor shaft, with the holddown elements applying a cleaning action on the rotor shaft. The manipulating mechanism for the holddown elements and brake shoe are such as to apply a greater force downwardly through the holddown elements than is applied upwardly by the brake shoe so that the rotor shaft will remain in the nip of the bearing support discs during the application of braking by the brake shoe. Further, the coefficient of friction between the brake shoe and the rotor shaft is greater than the coefficient of friction between the holddown elements and the rotor shaft to avoid undue friction on the rotor shaft at the location of the bearing support discs.

8 Claims, 2 Drawing Sheets

BRAKING DEVICE FOR A ROTOR SHAFT OF A ROTOR SPINNING MACHINE

BACKGROUND OF THE INVENTION

The present invention relates to a braking device for the rotor shaft of an open end rotor spinning machine, and more particularly to such a braking device used in the spin box of a rotor spinning machine in which the rotor shaft is supported in a pair of spaced bearing discs.

In the operation of open end rotor spinning machines, the rotor is occasionally stopped when a yarn break occurs or when a bobbin change is necessary, or at other occurrences. When this happens, a braking device is used to stop rotation of the shaft.

It has been observed that when the rotor shaft is out of operation that trash in the form of yarn softeners, yarn fragments and dust have accumulated between the contact surfaces of the bearing support discs and the rotor shaft, with the result that the rotor is no longer capable of running smoothly and evenly upon resumption of operation.

With prior art braking devices, a rotor brake acts through a brake shoe that either presses down against the rotor shaft between and at a spacing from the bearing support discs or acts upwardly against the rotor shaft between the bearing support discs to press the shaft against an auxiliary bearing member. With these braking devices the rotor shaft is engaged between the rotor discs and not within the rotor shaft support areas of the bearing support discs. Thus, the prior art braking devices can serve no purpose in eliminating or reducing contamination from trash and consequential uneven rotation of the rotor shaft on the bearing support discs.

The present invention is directed to eliminating or minimizing trash that accumulates on the bearing support discs and supported rotor shaft, by utilizing a new and improved braking device.

SUMMARY OF THE INVENTION

Briefly described, the present invention provides a braking device for a rotor shaft of a rotor spinning machine in which the rotor shaft is supported by the nips of two spaced pairs of rotatable disc bearings. It includes a brake shoe movably mounted between the disc pairs and below the rotor shaft for moving into braking engagement with the rotor shaft. A pair of holddown elements are mounted above the disc pairs and are movable against the rotor shaft to hold the rotor shaft against the disc pairs upon braking engagement of the brake shoe with the rotor shaft. Means are provided for manipulating the brake shoe into rotor shaft braking engagement and for moving the holddown elements into rotor shaft holddown engagement. With this arrangement, the friction of the holddown elements against the rotor shaft provides a scraping or cleaning action to remove trash deposits from the rotor shaft and the trash that is transmitted from the bearing support discs onto the rotor shaft. As the rotor shaft is normally braked on occasions during operation of the machine, there occurs an automatic periodic cleaning of the rotor shaft at each braking such that contaminations no longer exhibit a substantial noticeable deleterious effect.

Preferably, the means for manipulating the brake shoe and the holddown elements is arranged for applying a greater holddown force through the holddown elements than an upward force through the brake shoe so that the rotor shaft is maintained on the disc pairs by the force of the holddown elements during the braking action. In the preferred embodiment the manipulating means distributes a common applied force into holddown and braking forces so that a single braking force application to the braking device is all that is needed to obtain braking and also the aforementioned distribution of the force for greater application through the holddown elements than through the brake shoe.

To accomplish this uneven distribution of applied force, the holddown elements are mounted on levers pivoted at a first fixed pivot point spaced laterally from the rotor shaft and having an operating arm extending laterally toward the rotor shaft from the first fixed pivot point. The brake shoe is mounted on a lever pivoted at a second fixed pivot point spaced laterally from and between the shaft and the first fixed pivot point. An operating lever is pivoted to the operating arm at a first operating pivot point between the first and second fixed pivot points and also pivoted to the brake shoe lever at a second operating pivot point between the second fixed pivot point and the brake shoe. Further, the operating lever has an actuating arm extending laterally outward from the first operating pivot point, and means are provided for applying a downward force to the actuating arm. With this arrangement, the manipulating means forces the holddown elements and brake shoe against the rotor shaft with a greater force applied to the holddown elements than through the brake shoe.

In the preferred embodiment, the operating arm extends generally horizontally from the first fixed pivot point, and the second operating pivot point is disposed above the level of both the first operating pivot point and the second fixed pivot point and laterally inwardly toward the shaft. Further, the first operating pivot point is spaced from the first fixed pivot point a distance greater than the second operating pivot point is spaced from the second fixed pivot piont. With this arrangement, a downward force applied to the actuating arm of the operating lever acts through the operating arm of the holddown lever to apply a greater force by the holddown elements against the rotor shaft than is applied by action of the force through the operating lever, brake shoe lever and brake shoe against the rotor shaft from below.

A further feature of the braking device of the present invention is the provision that the coefficient of friction between the brake shoe and the rotor shaft is greater than the coefficient of friction between the holddown elements and the rotor shaft. This is advantageous as it minimizes the harmful effect of friction acting through the holddown elements on the rotor shaft at the location of the support on the bearing support discs, and rather concentrates the friction braking action at the brake shoe contact with the rotor shaft where the rotor shaft is not supported by the discs during normal operation.

Further features and advantages of the present invention will be apparent from the accompanying drawings and following detailed description.

DETAILED DESCRIPTION OF THE PREFERRED EMBODIMENT

Figure 1:
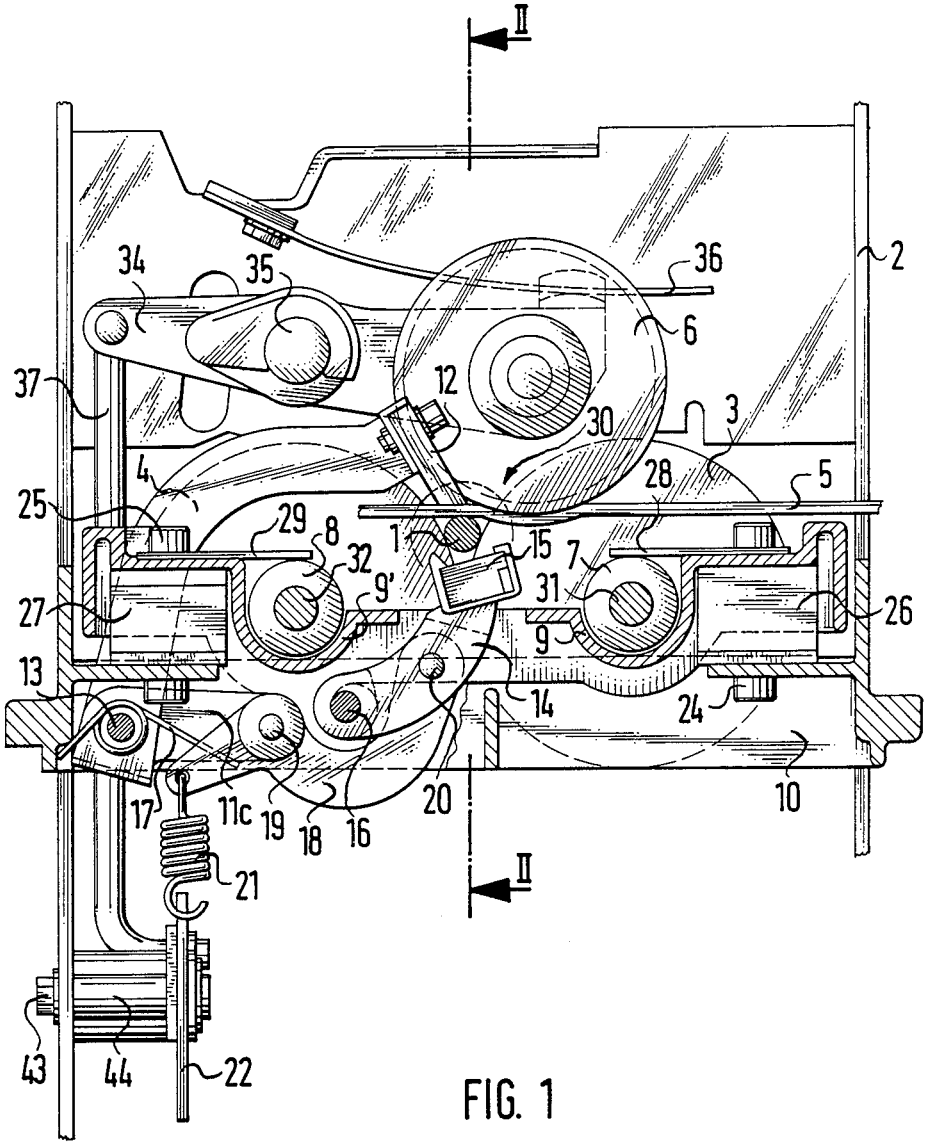
FIG. 1 is a vertical sectional view of a spin box of an open end rotor spinning machine incorporating the preferred embodiment of the braking device of the present invention, as viewed along line I—I of FIG. 2.

Referring to the figures, the braking device of the preferred embodiment of the present invention is shown mounted on a frame 2 having a support 10 to which support brackets 9,9' are fastened by bolts 24,25 through shims 26,27 that properly position the brackets 9,9' for support of cylindrical bearings 7,8 in which bearing support discs 3,4 rotate. Plates 28,29 extend from under the top of the bolts 24,25 over the tops of the cylindrical bearings 7,8 to hold the cylindrical bearings 7,8 in place on the brackets 9,9'.

Figure 2:
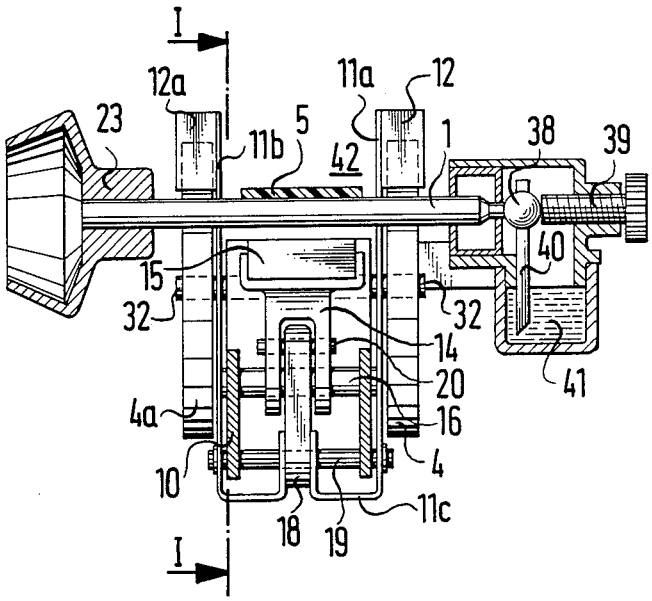
FIG. 2 is a vertical sectional view taken along line II—II of FIG. 1.

The bearing support discs 3,4 form a pair having a nip area 30 in which the shaft 1 of the rotor 23 is supported. In FIG. 2, it is seen that there are two spaced pairs of bearing support discs, one being the aforementioned pair 3,4 and the other being the pair, one of which 4a is illustrated. The shafts of the support discs are represented by the reference numerals 31 and 32.

The rotor shaft 1 is driven tangentially by a belt 5 that travels along the length of the machine and is pressed against the rotor shaft 1 for driving rotation of the shaft by a pressure roller 6 that is offset from the rotor shaft 1 to effect angular driving contact over an arc of the periphery of the rotor shaft 1. This pressure roller 6 is mounted on a rocker arm 34 that is pivoted about an axis 35 for movement of the roller 6 toward and away from driving engagement with the belt 5. A leaf spring 36 is mounted on the frame 2 and is biased into downward pressing engagement against the pressure roller 6 to normally urge the pressure roller into rotor shaft driving engagement with the belt 5. The rocker arm 34 is articulated by a vertically extending actuating rod 37 that is connected at a location below the bearing support discs 3,4 to an actuation lever 22. Upon actuation of the lever 22, the pressure roller 6 is raised against the pressure of the leaf spring 36 out of driving engagement with the belt 5, thereby disengaging the rotor from operation.

As seen in FIG. 2, the inner end of the rotor shaft 1 is postioned by a ball 38 against an adjusting screw 39 and rotatably held in a frame 40 that extends into an oil bath 41 for lubrication of the ball 38.

The mechanism described to this point is a known construction and it is in this environment that the braking device 42 of the present invention is incorporated. This braking device 42 includes a brake shoe 15 located between the pairs of rotatable disc bearings **3,4,4*a* and below the rotor shaft 1 for moving into braking engagement with the rotor shaft. The braking device 42 also includes a pair of holddown elements 12,12*a* mounted above the disc pairs 3,4,4*a* and movable against the rotor shaft 1 to hold the rotor shaft 1 against the bearing disc pairs upon braking engagement of the brake shoe 15 with the rotor shaft 1**.

Holddown element 12 is mounted on a lever **11*a* and holddown element 12*a* is mounted on a lever 11*b*, with the levers being mounted on a common shaft 13 that is mounted on the support frame 10. FIG. 1 illustrates the holddown lever 11*a* with the shaft 13 providing a first fixed pivot point spaced laterally from the rotor shaft 1. The holddown lever 11*a* has an operating arm 11*c* extending laterally toward the rotor shaft from the first fixed pivot point 13, and a spiral spring 17 is wound on the shaft 13 with ends engaging the frame 10 and the underside of the operating arm 11*c* to normally bias the holddown lever 11*a* upwardly to position the holddown element 12 upwardly out of engagement with the rotor shaft 1, as shown in FIG. 1**.

The operating arm **11*c* has mounted on it a stub shaft 19 that forms a first operating pivot point on which an operating lever 18 is pivotally mounted. The operating lever 18 extends toward the brake shoe 15 and is pivotally mounted on another stub shaft 20 that forms a seconds operating pivot point. This stub shaft 20 is mounted on a brake shoe lever 14 having the brake shoe 15 attached at one end and being pivoted on a shaft 16 mounted on the frame 10 that provides a second fixed pivot point that is spaced laterally from and between the rotor shaft 1 and the first fixed pivot point 13**.

The components are so arranged that the first operating pivot point 19 is between the first and second fixed pivot points 13,16 and the second operating pivot point 20 is between the second fixed pivot point 16 and the brake shoe 15.

The operating lever 18 has an actuating arm extending laterally outward from the first operating pivot point 19 and has attached to it a coil spring 21 that extends downwardly and is attached to the aforementioned actuation lever 22. Thus, the spring 21 and actuation lever 22 serve as means for applying a downward force to the actuating arm of the operating lever 18 to apply a manipulating force to the holddown elements **12,12*a* and to the brake shoe 15**.

In the preferred embodiment illustrated, the operating arm **11*c* of the holddown levers 11*a*,11*b* extends generally horizontally from the first fixed pivot point 13, and the second operating pivot point 20 is disposed above the level of the first operating pivot point 19 and above the level of the second fixed pivot point 16 and is disposed laterally inwardly toward the shaft 1 from the second fixed pivot point 16. In addition, the first operating pivot point 19 is spaced from the first fixed pivot point 13 a distance greater than the spacing of the second operating pivot point 20 from the second fixed pivot point 19. With this arrangement of pivot points and levers, a downward force applied by the actuation lever 22 through the spring 21 on the actuating arm of the operating lever 18 causes a downward rotation of the operating arm 11*c* of the holddown levers 11*a*,11*b* to cause the holddown elements 12,12*a* to move into holddown engagement with the rotor shaft 1 and hold it in position on the bearing support discs 3,4,4*a*. At the same time, the downward application of the force by the actuation lever 22 through the spring 21 causes an upward rotation of the second operating pivot point 20 due to the fact that the movement of the first operating pivot point 19 is predominantly downward along the arc of rotation about the first fixed pivot point 13 whereas the second operating pivot point 20 is located above the second fixed pivot point 16 and must follow an arcuate path of shorter radius than the radius of the path of the first operating pivot point 19 and in a path that has an inclination to the vertical. Because of this relative location of the pivot points, a downward movement of the first operating pivot point 19 will cause an upward movement of the second operating pivot point, causing the brake shoe 15 to move into braking engagement with the rotor shaft 1**.

Also, the relationship of the pivot points as described results in the distribution of the force applied through the spring 21 to apply a greater holddown force through the holddown elements **12,12*a* than the upward force applied by the brake shoe 15 so that the holddown elements 12,12*a*** will predominate to hold the rotor shaft 1 in the nip of the bearing support discs 3,4,4*a* while the brake shoe 15 is applying a brake force to the rotor shaft 1.

The actuating lever 22, as mentioned previously, also acts through the actuation rod 37 to raise the pressure roller 6 out of engagement with the drive belt 5 so that when the braking device 42 is actuated the roller 6 will be deactivatged to remove the driving force of the belt 5 from the rotor shaft 1.

The actuating lever 22 is pivoted on the frame 10 by being mounted on a shaft 44 attached to the frame 10 by a bolt 43. Thus, a pivoting force applied to the actuating lever 22 will be transmitted through the spring 21 to actuate the braking device 42, which is normally positioned in a non-braking disposition by the aforementioned spring 17, against which the actuation lever 22 and coil spring 21 act in transmitting an actuating force to the braking device 42.

To avoid application of excessive friction and its attendant disadvantage on the condition of the rotor shaft 1 in its engagement with the bearing support discs 3,4,4*a* the holddown elements 12,12*a* are formed of a material of relatively low coefficient of friction. Any suitable material for this purpose may be selected from conventionally available materials. On the other hand, the material of the brake shoe 15 should be of relatively high coefficient of friction to apply a braking friction to the rotor shaft 1. Any conventional suitable brake shoe material may be used for this purpose. The relationship is such that the coefficient of friction between the brake shoe 15 and the rotor shaft 1 is greater than the coefficient of friction between the holddown elements 12,12*a* and the rotor shaft 1.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A braking device for a rotor shaft of a rotor spinning machine in which the rotor shaft is supported by the nips of two spaced pairs of rotatable disc bearings, said braking device comprising a brake shoe movably mounted between said disc pairs and below said rotor shaft for moving into braking engagement with said rotor shaft, a pair of holddown elements mounted above said disc pairs and movable against said rotor shaft to hold said rotor shaft against said disc pairs upon braking engagement of said brake shoe with said rotor shaft.

2. A braking device according to claim 1 and characterized further by means for manipulating said brake shoe into rotor shaft braking engagement and for moving said holddown elements into rotor shaft holddown engagement.

3. A braking device according to claim 2 and characterized further in that said manipulating means is arranged for applying a greater holddown force through said holddown elements than an upward force through said brake shoe so that said rotor shaft is retained on said disc pairs during braking action.

4. A braking device according to claim 3 and characterized further in that said manipulating means distributes a common force into said holddown and braking forces.

5. A braking device according to claims 1, 2, 3 or 4 and characterized further in that the coefficient of friction between said brake shoe and said rotor shaft is greater than the coefficient of friction between said holddown elements and said rotor shaft.

6. A braking device according to claim 4 and characterized further in that said holddown elements are mounted on levers pivoted at a first fixed pivot point spaced laterally from said rotor shaft and having an operating arm extending laterally toward said rotor shaft from said first fixed pivot point, said brake shoe is mounted on a lever pivoted at a second fixed pivot point spaced laterally from and between said shaft and said first fixed pivot point, an operating lever pivoted to said operating arm at a first operating pivot point between said first and second first pivot points and pivoted to said brake shoe lever at a second operating pivot point between said second fixed pivot point and said brake shoe, said operating lever having an activating arm extending laterally outward from said first operating pivot point, and means for applying a downward force to said actuating arm to cause said manipulating means to force said holddown elements and brake shoe against said rotor shaft with a greater force applied through said holddown elements than through said brake shoe.

7. A braking device according to claim 6 and characterized further in that said operating arm extends generally horizontally from said first fixed pivot point, said second operating pivot point is disposed above the level of said first operating pivot point and said second fixed pivot point and laterally inwardly toward said shaft.

8. A braking device according to claim 6 or 7 and characterized further in that said first operating pivot point is spaced from said first fixed pivot point a distance greater than said second operating pivot point is spaced from said second fixed pivot point.

* * * * *